US005307887A

United States Patent [19]

Welsh

[11] Patent Number: 5,307,887

[45] Date of Patent: May 3, 1994

[54] EARTH BORING BIT WITH IMPROVED THRUST BEARING

[75] Inventor: Michael F. Welsh, Houston, Tex.

[73] Assignee: Baker Hughes Incorporated, Houston, Tex.

[21] Appl. No.: 922,308

[22] Filed: Jul. 30, 1992

[51] Int. Cl.[5] ..... E21B 10/22

[52] U.S. Cl. ..... 175/371; 384/92; 384/93; 384/94

[58] Field of Search ..... 175/371, 372; 384/92, 384/93, 94

[56] References Cited

U.S. PATENT DOCUMENTS

| | | | |
|---|---|---|---|
| 3,397,928 | 8/1968 | Galle . | |
| 3,656,764 | 4/1972 | Robinson | 175/371 X |
| 4,157,122 | 6/1979 | Morris | 175/369 |
| 4,516,641 | 5/1985 | Burr | 175/228 |
| 4,554,985 | 11/1985 | Backlund | 175/371 |
| 4,588,309 | 5/1986 | Uyehara et al. | 175/371 X |
| 4,753,304 | 6/1988 | Kelly | 175/371 |
| 4,899,838 | 2/1990 | Sullivan et al. | 175/371 |

*Primary Examiner*—Stephen J. Novosad

*Attorney, Agent, or Firm*—Felsman, Bradley, Gunter & Dillon

[57] ABSTRACT

An earth boring bit having a body and a cantilevered bearing shaft extending inwardly and downwardly from the body. A rotatable cutter with an open end is assembled over the shaft, which has a radial bearing surface formed around a longitudinal axis. The cutter has a radial bearing surface sized to permit assembly over the journal surface of the shaft. The shaft and cutter have opposed thrust bearing surfaces, one of which has a gradually tapered outer region and a planar inner region to gradually reduce peak stress from a maximum to a minimum and avoid abrupt changes in stress from a high to a low value.

12 Claims, 5 Drawing Sheets

EARTH BORING BIT WITH IMPROVED THRUST BEARING

BACKGROUND OF THE INVENTION

1. Field of the Invention

This invention relates to earth boring bits, especially those having rolling cutters supported upon lubricated bearing shafts. The improvement relates specifically to the bearings in such bits.

2. Description of the Prior Art

The commercially successful earth boring bit used for drilling oil and gas wells has a body typically formed of three identical sections, each with a cantilevered bearing shaft that supports a rotatable cutter. An example of one version may be seen with reference to Bruce H. Burr, U.S. Pat. No. 4,516,641.

Here, the bearing is of the "journal" type, meaning that there are no rollers to support the load between the shaft and the cutter. The journal bearing has proved superior in most oil and gas well drilling environments since the inception of the successful bearing and seal system shown in U.S. patent of Edward M. Galle, No. 3,397,928.

In such bits there is often a high unit stress loading imposed on the journal bearing shaft by the corner region of the opposed seal ring groove in the cutter. The hard surface of the heat treated journal bearing surface sometimes cracks and spalls when subjected to sustained high unit loading imposed by the cutter, especially opposite the corner of the seal groove. This condition has been observed in bits sealed with O-rings and has become more prevalent in bits sealed with the improved metal face seals of Pat. No. 4,516,641.

There are also high unit stress loadings imposed on the radial thrust bearing surfaces used to resist the outward thrusts of the cutters during drilling. The cutters of a rock bit tend to wobble during drilling or assume a cocked position on the bearing shaft. This creates additional stresses on the thrust bearing.

SUMMARY OF THE INVENTION

It is the general object of the invention to provide an earth boring bit having a rotatable cutter supported upon a bearing, with means to reduce the stress imposed by the cutter upon the thrust bearing during drilling.

This and other objects of the invention are achieved in a bit having a body and a cantilevered bearing shaft extending inwardly and downwardly from the body. A rotatable cutter with an open end is assembled over the shaft, which has a cylindrical bearing surface formed around a longitudinal axis. At the open end of the cylindrical cutter bearing surface is a seal groove which includes an intersecting wall that defines an annular, generally curved corner to oppose the journal surface of the shaft. Within the seal groove is a seal to confine lubricant between the bearing surf aces. The cutter bearing surface preferably has a curved outer region that converges from the annular corner of the seal groove into an inner region to reduce the peak stress the corner induces upon the journal bearing surface of the shaft, including the stress induced by cutter cocking during drilling. The shaft and cutter have opposed thrust bearing surfaces, one of which has a gradually tapered outer region and a planar inner region to gradually reduce stress from a maximum to a minimum and avoid abrupt changes in stress from a high to a low value.

Additional objects, features and advantages of the invention will become apparent in the following description.

DESCRIPTION OF THE PREFERRED EMBODIMENT

Figure 1:
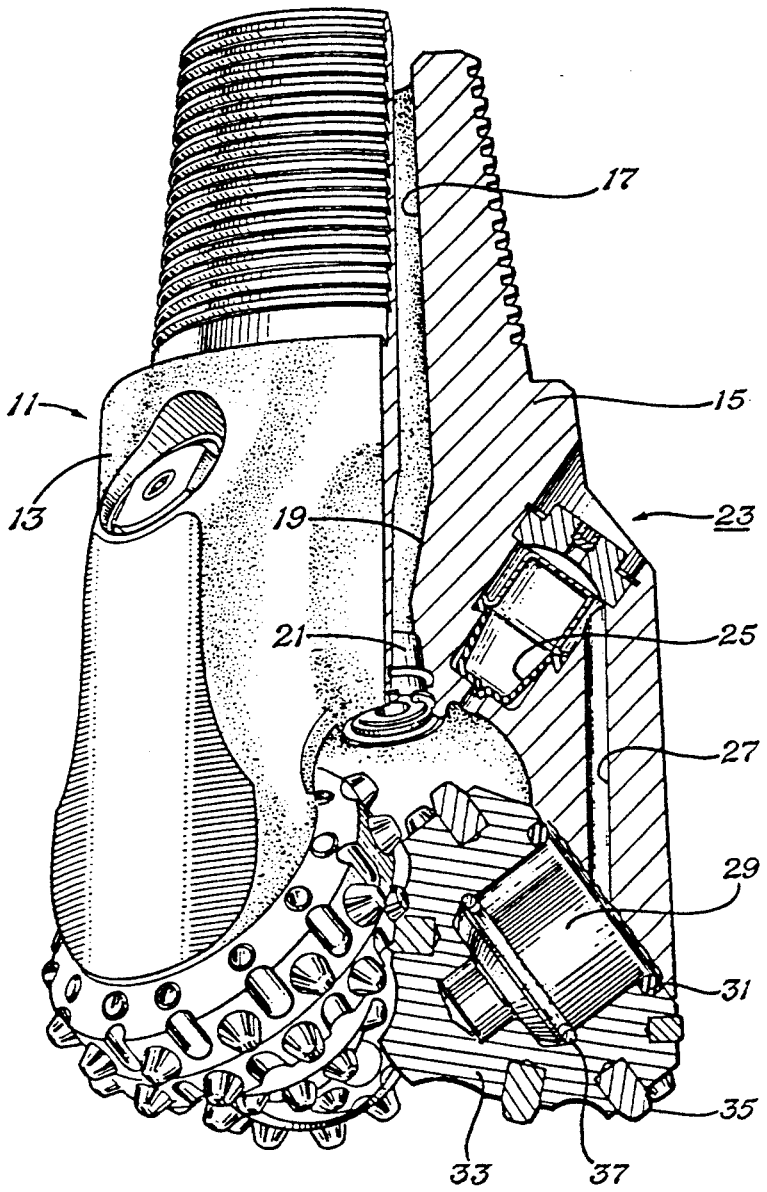
FIG. 1 a perspective, view partially in longitudinal section, of an earth boring bit which embodies the principles of the invention.

The numeral 11 in the drawings designates an earth boring bit of the rolling cone or cutter type. Typically the bit has a body 13 constructed of three identical sections 15, welded to form fluid tight central bore 17 that leads to one of three identical passages 19 and an associated wear and erosion resistant nozzle 21.

Each section 15 of the body includes a lubrication system 23 with a flexible diaphragm pressure compensator 25 to provide lubricant through a passage 27 and to a bearing means 29. A seal ring 31 confines lubricant within the bearing means 29 and inside the rotatable cutter 33 to lengthen its life and that of its earth disintegrating teeth 3 5. Each of the cutters 33 is retained in this instance to the bearing means 29 by suitable means such as the snap ring 37, as disclosed by Bruce H. Burr in U.S. Pat. No. 4,491,428. The conventional ball bearing cutter retainer means may also be utilized as an alternate.

Figure 2:
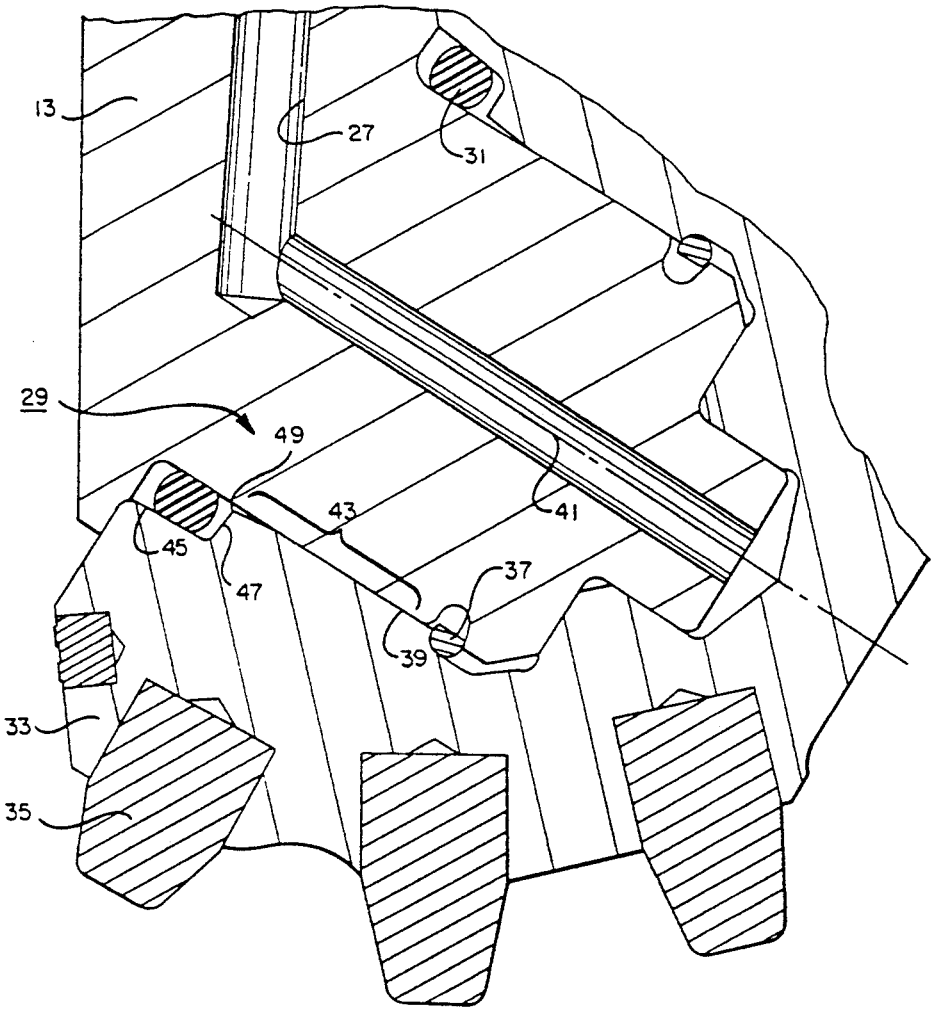
FIG. 2 is a fragmentary longitudinal section of a bit having a modified form of seal groove in the rotatable cutter and the features of the invention.

With reference to FIG. 2, the bearing means 29 consist of a cantilevered bearing shaft with a first cylindrical journal bearing surface 39 formed around a longitudinal axis 41 which extends inwardly and downwardly relative to the bit body 13.

The cutter 33 is secured for rotation about the bearing shaft, with a second cylindrical journal bearing surface 43 sized to include normal clearance to permit assembly over the journal surface 39. During drilling the cutter bearing surface 43 opposes and engages the lower or so called "pressure side" of the cylindrical bearing surface 39 of the bearing shaft.

The seal ring 31 is in a groove 45 at the open end of the cutter, the groove having a radial wall 47 which intersects the cutter bearing surface 43 to define a generally curved corner 49 that opposes the cylindrical bearing surface 39 of the shaft. The corner 49 is normally rounded with a small radius to remove its otherwise sharp edge. High stresses are imposed by the cutter on the pressure side of the shaft, especially by the corner 49 during drilling when the cutter becomes cocked.

Figure 3:
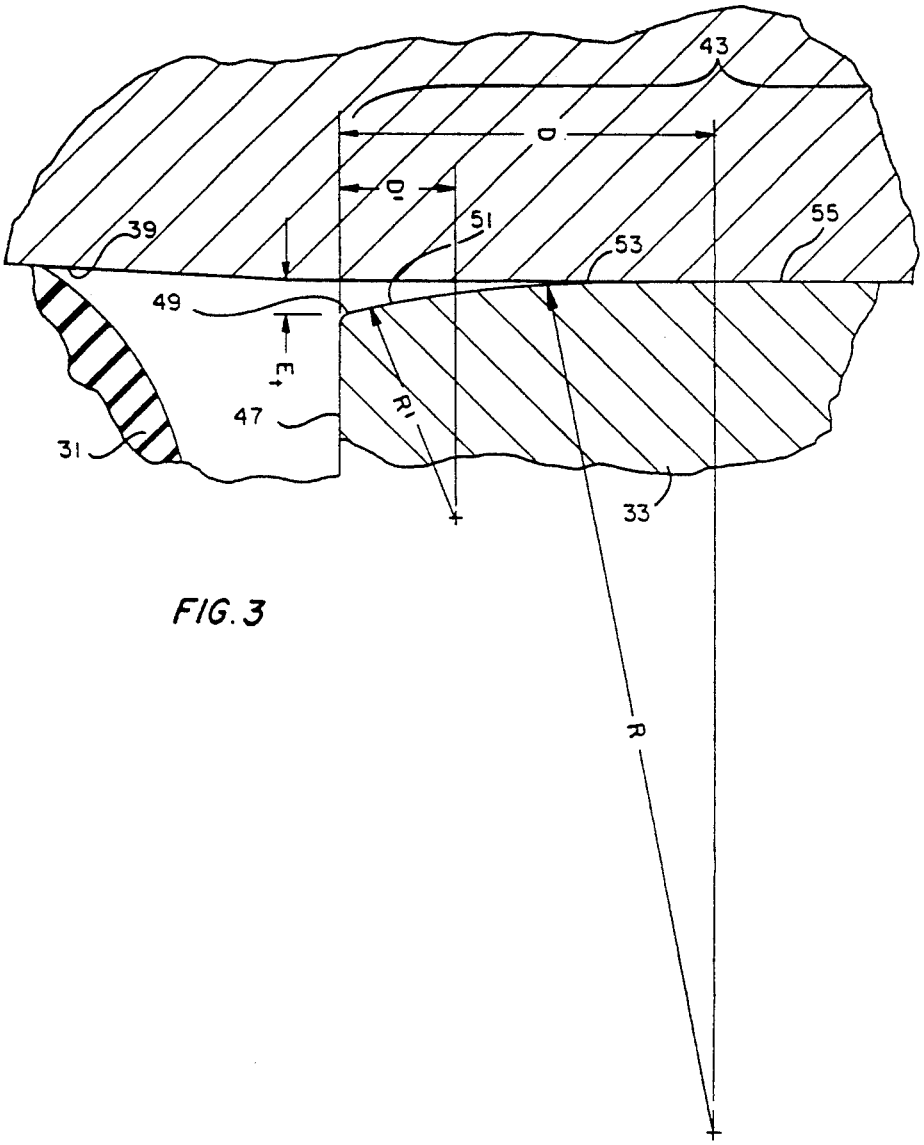
FIG. 3 is an enlarged, fragmentary longitudinal section of that portion of the FIG. 2 bit in the region of the seal groove.

The preferred shape and position of the cutter bearing surfaces 43 are shown in FIG. 3. A curved, outer region of the cutter bearing surface 43 is composed of an outer portion 51 and an inner portion 53. This curved region is longitudinal to the cylindrical, inner region 55 of the cutter bearing. In this embodiment the curved outer region consists of a first toroidal portion 51 and a second toroidal portion 53 which provide a clearance $E_t$ between the cylindrical bearing surface 39 and the corner 49 when the cutter bearing engages the shaft journal during drilling and in the illustrated "uncocked" position. This clearance gradually diminishes such that there is a reduction of the varisbiyon in stress along the shaft bearing surface 39 caused the engagement with the bearing surfaces 43 of the cutter.

The dimensions defining the toroidal portions 51, 53 of the cutter bearing surfaces 43 in a successful test "Hughes" 12 ¼ ATJ-11 drill bit are as follows:

$E_t$=0.0020 inch
$D_1$=0.150 inch
D=0.753 inch
R=185 inch
$R_1$=20 inch

The distance D is about one half the length of the cutter bearing surfaces.

The use of the cutter bearing surfaces 43 as shown and described has successfully reduced stress and unit loading on the bearing surface 39 of a bearing shaft in the vicinity of the corner 49. This reduction of stress has been observed to have reduced cracks and spalling of the bearing surface 39 and consequently will contribute to the useful life of the bits in which the invention is used.

In FIG. 2 of the drawings the bearing shaft has a thrust bearing 57 that will be called the "first" thrust bearing to distinguish it from the "second" thrust bearing 59 of the cutter bearing. These thrust surfaces oppose and engage each other during drilling to resist the outward movements of the cutter on the bearing shaft. The thrust bearing surfaces 57, 59 experience abrupt changes in load and stress during drilling since the normal clearances between the bearing shaft and the cutter bearing permit the cutter to cock and to wobble as the cutter rotates around the bearing shaft.

The outer peripheral edge or corner of the thrust bearing surface 57 of the bearing shaft is a highly stressed region, as is the opposed region of the thrust surface 59 of the cutter bearing. Moreover, these stresses is are cyclical in nature and change from high values to low values near the outer periphery or corner of the first thrust surface 57 where the stress abruptly goes from large to essentially zero. This sometimes leads to premature wear and bearing failure even though the prior art bits use relatively small radii or bevels at the outer periphery or corner in an attempt to alleviate the problem.

Figure 4:
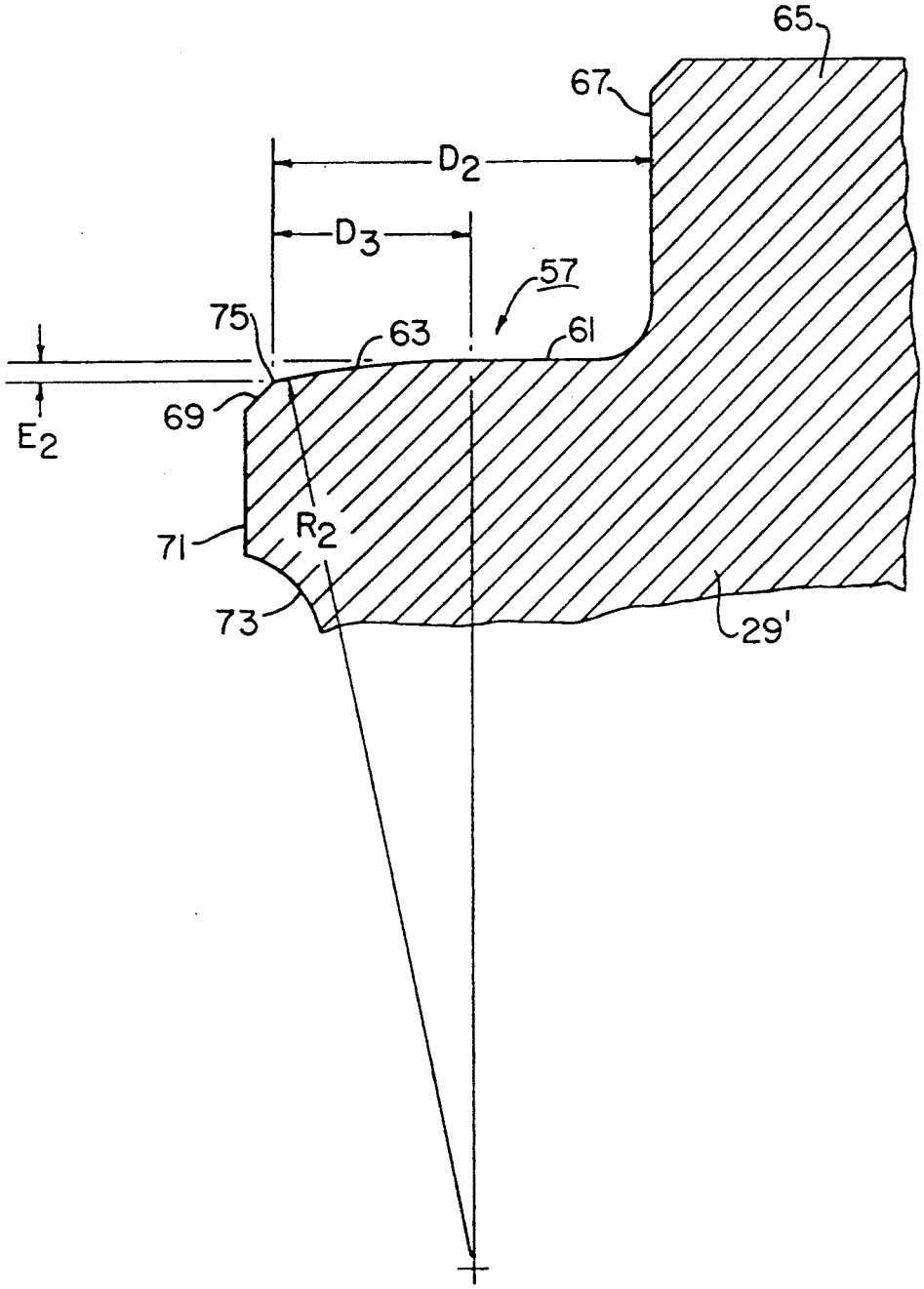
FIG. 4 is an enlarged, fragmentary longitudinal section of a portion of the pilot pin and radial thrust face of the bearing shaft.

FIG. 4 shows in fragmentary longitudinal section one end of the bearing shaft 29' of FIG. 2, including the thrust surface 57 that has an inner, planar region 61 and an outer tapered region 63. A bevel 69 connects the outer region 63 with the cylindrical, journal bearing surface 71 that contains a groove 73 used as a part of the retainer means to hold the cutter on the bearing shaft. The planar region 61 intersects through a radius the cylindrical surface 67 of the pilot pin 65 of the bearing shaft.

For a 12 ¼ inch drill bit typical dimensions are as follows:

$E_2$=0.0009 inch
$D_3$=0.225 inch
$D_2$=0.718 inch
$R_2$=40 inch

The distance $D_3$ across the tapered outer region 63 should be in a range of about 0.200 to 0.250 inch and $E_2$, which is the nominal clearance between the outer corner 75 of the first thrust bearing surface 57 and the opposed second thrust bearing surface 59 of the cutter, should be about 0.001 inch. The radius $R_2$ is calculated once the above dimensions are selected. These dimensions result in a configuration to reduce peak stress from a maximum to a minimum over the trust faces and avoid abrupt changes in stress.

Figure 5:
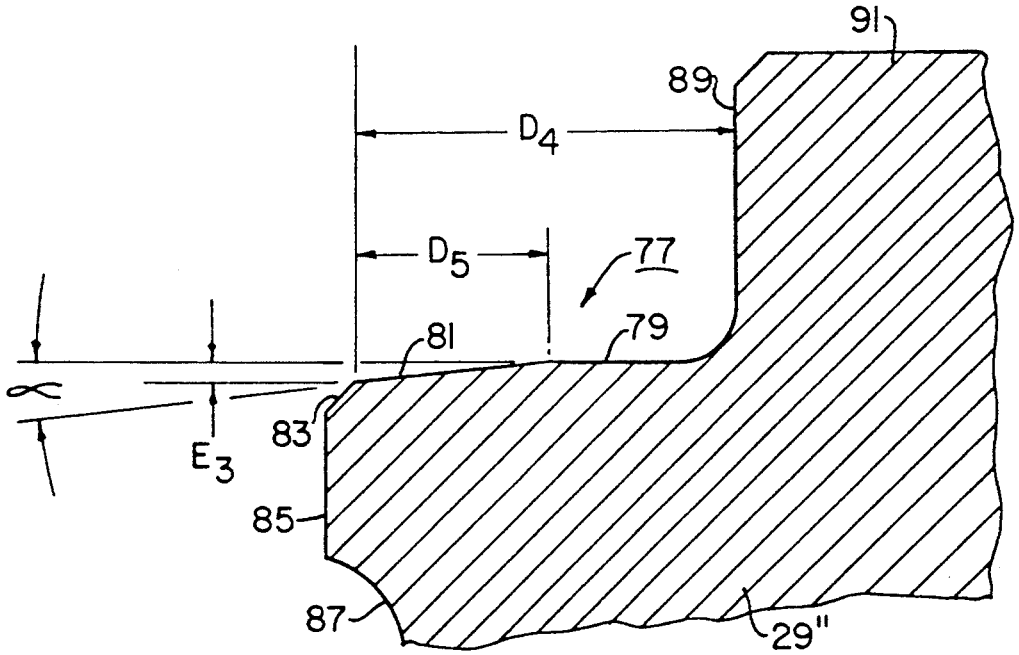
FIG. 5 is an enlarged, fragmentary longitudinal section showing an alternate embodiment of the radial thrust faces of the bearing.

FIG. 5 shows an alternate embodiment of the invention in a longitudinal section. Here, one end of the bearing shaft 2911 includes the first thrust surface 77 that has an inner, planar region 79 and an outer tapered region 81. A bevel 83 connects the outer region 81 with a cylindrical, journal bearing surface 85 that contains a groove 87 used a part of the retainer means to hold the cutter on the bearing shaft. The planar region 79 intersects through a radius the cylindrical surface 89 of the pilot pin 91 of the bearing shaft 29".

For a 12¼ inch drill bit, dimensions are as follows:

$\alpha$=0 degrees 14 minutes
$E_3$=0.0009 inch
$D_4$=0.718 inch
$D_5$=0.225 inch The FIG. 5 embodiment replicates the FIG. 4 embodiment by substituting the beveled outer region 81 for the curved or toroidal inner region 63. The FIG. 4 embodiment has inner and outer surfaces 61, 63 that are mathematically tangent, whereas the FIG. 5 embodiment approximates a tangential relationship between the inner and outer surfaces 79, 81 as close as practicable.

While the invention has been described in only a few of its forms, it should be apparent to those skilled in the art that it is not thus limited, but is susceptible to various changes and modifications without departing from the spirit thereof.

I claim:

1. An earth drilling bit which comprises:

a body;

a cantilevered bearing shaft extending inwardly and downwardly from the body, the bearing shaft having a bearing axis;

a cutter rotatably secured to the bearing shaft, with an open end to permit assembly over the cantilevered bearing shaft;

the bearing shaft having a first thrust bearing surface extending radially outward and generally transversely to the bearing axis;

the cutter having a second thrust bearing surface to oppose and engage the first thrust bearing surface of the bearing shaft;

one of said thrust bearing surfaces having a gradually tapered outer region and a planar inner region configured to reduce peak stress and void abrupt changes in stress.

2. The invention defined by claim 1 wherein a distance across the tapered outer region of the thrust bearing is in the range of 0.200 to 0.250 inch.

3. The invention defined by claim 1 wherein the nominal clearance between an outer corner of the first thrust bearing surface and the second thrust bearing surface is about 0.001 inch.

4. The invention defined by claim 1 wherein the angle of the gradually tapered outer region in relation to the inner region is less than ¼ of a degree.

5. An earth boring bit which comprises:

a body;

a cantilevered bearing shaft extending inwardly and downwardly from the body, the bearing shaft having a bearing axis;

a cutter rotatably secured to the bearing shaft, with an open end to permit assembly over the cantilevered bearing shaft;

the bearing shaft having a first thrust bearing surface extending radially outward and generally transversely to the bearing axis;

the cutter having a second thrust bearing surface to oppose and engage the fist thrust bearing surface of the bearing shaft;

a seal groove at the open end of the cutter bearing surface, including an intersecting wall that defines an annular, generally rounded corner to oppose the bearing shaft;

seal means disposed in the seal groove to confine lubricant between the bearing surface;

the cutter bearing surface having a tapered outer region that converges from the annular corner of the seal groove into an inner region to reduce the stress the corner induces upon the shaft during drilling;

one of said thrust bearing surfaces having a gradually tapered outer region and a planar inner region configured to reduce peak stress and avoid abrupt changes in stress.

6. The invention defined by claim 5 wherein a distance across the tapered outer region of the thrust bearing is in the range of 0.200 to 0.250 inch.

7. The invention defined by claim 5 wherein the nominal clearance between an outer corner of the first thrust bearing surface and the second thrust bearing surface is about 0.001 inch.

8. The invention defined by claim 5 wherein the angle of the gradually tapered outer region in relation to the inner region is less than ¼ of a degree.

9. An earth drilling bit which comprises:

a body;

a cantilevered bearing shaft extending inwardly and downwardly from the body;

a cutter rotatably secured to the bearing shaft, with an open end to permit assembly over the cantilevered bearing shaft;

the bearing shaft having a first journal bearing surface formed around a longitudinal axis and a first thrust bearing surface extending transversely of the journal bearing;

the cutter having an open end and a second journal bearing surface sized to permit assembly over the first journal surface of the shaft and a second thrust bearing surface to oppose and engage the first thrust bearing surface;

a seal groove adjacent the open end of the cutter bearing surface, including a generally cylindrical wall and an intersecting, generally radial wall that defines an annular, generally rounded corner of the seal groove to oppose the first journal surface of the shaft;

seal means disposed in the seal groove to confine lubricant between the bearing surfaces;

the cutter second journal bearing surface having a curved outer region that converges from the annular corner of the seal groove into an inner region to reduce the stress the corner induces upon the journal bearing surface of the shaft during drilling;

one of said thrust bearing surfaces having a gradually tapered outer region and a planar inner region configured to reduce peak stress and avoid abrupt changes in stress.

10. The invention defined by claim 9 wherein a distance cross the tapered outer region of the thrust bearing is in the range of 0.200 to 0.250 inch.

11. The invention defined by claim 9 wherein the nominal clearance between the outer corner of the first thrust bearing surface and the second thrust bearing is about 0.001 inch.

12. The invention defined by claim 9 wherein the angle of the gradually tapered outer region in relation to the inner region is less than ¼ of a degree.

* * * * *